US010526182B2

(12) United States Patent
Clusserath et al.

(10) Patent No.: US 10,526,182 B2
(45) Date of Patent: Jan. 7, 2020

(54) FILLING DEVICE

(75) Inventors: Ludwig Clusserath, Bad Kreuznach (DE); Timo Jakob, Framersheim (DE); Thomas Stolte, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 674 days.

(21) Appl. No.: 14/241,209

(22) PCT Filed: Jun. 28, 2012

(86) PCT No.: PCT/EP2012/002708

§ 371 (c)(1),
(2), (4) Date: Feb. 26, 2014

(87) PCT Pub. No.: WO2013/029706

PCT Pub. Date: Mar. 7, 2013

(65) Prior Publication Data

US 2014/0202592 A1 Jul. 24, 2014

(30) Foreign Application Priority Data

Aug. 26, 2011 (DE) ..... 10 2011 111 321

(51) Int. Cl.
*B67C 3/24* (2006.01)
*B67C 3/26* (2006.01)

(52) U.S. Cl.
CPC ..... *B67C 3/24* (2013.01); *B67C 2003/2657* (2013.01)

(58) Field of Classification Search
CPC ..... B67C 3/24; B67C 2003/2657
USPC ..... 141/369, 165, 147, 146, 370, 371, 372, 141/144, 145, 143, 57, 192, 51, 62, 286; 198/478.1, 441, 470.1
See application file for complete search history.

(56) References Cited

U.S. PATENT DOCUMENTS 582,285 A * 5/1897 Henes ..... B67C 3/06 141/39
874,874 A * 12/1907 Taylor ..... B65B 57/06 141/142
910,265 A * 1/1909 Baker ..... B65B 57/06 141/142
958,252 A * 5/1910 Jenkins ..... B65G 17/326 198/803.1
1,058,093 A * 4/1913 Phelps ..... B67D 7/54 141/113

(Continued)

FOREIGN PATENT DOCUMENTS

CA 432 532 1/1946
CH 348 623 8/1960

(Continued)

*Primary Examiner* — Jason K Niesz
*Assistant Examiner* — James Hakomaki
(74) *Attorney, Agent, or Firm* — Occhiuti & Rohlicek LLP

(57) ABSTRACT

An apparatus for filling cans with an uncarbonated liquid fill includes a rotatable rotor, can holders, filling elements, a can-pickup station, a can set-down station, and either a movable clamping element or an underpressure acting on a can's bottom. The filling operation is either pressureless filling, free-jet filling, or hot free-jet filling. During a filling operation, the rotor moves a can from the pick-up station to the set-down station. Either the clamping element or the underpressure then fixes the can to either a circumferential side with respect to the rotor or a filling-element support.

20 Claims, 6 Drawing Sheets

(56) References Cited

U.S. PATENT DOCUMENTS 1,119,389 A * 12/1914 Baker ..... B65B 57/06 141/142
1,730,381 A * 10/1929 Pennock ..... B67C 3/16 141/270
1,946,025 A * 2/1934 Lewis ..... B65B 3/323 141/146
1,998,462 A * 4/1935 Le Frank ..... B65B 3/14 141/305
2,070,616 A * 2/1937 Nordquist ..... B65B 3/14 141/147
2,124,581 A * 7/1938 Luthi ..... B67C 3/16 137/205
2,315,255 A * 3/1943 Giles ..... B65B 39/145 141/147
2,324,312 A * 7/1943 Meyer ..... B67B 3/003 198/463.4
2,362,793 A * 11/1944 Ayars ..... B65B 3/305 141/128
3,031,370 A * 4/1962 Shank, Jr. ..... B28B 11/001 118/230
3,040,787 A * 6/1962 Knoll ..... B65B 39/145 141/143
3,087,517 A * 4/1963 Magnuson ..... B65B 39/145 141/1
3,105,525 A * 10/1963 Boucher ..... B67C 3/001 141/101
3,207,325 A 9/1965 Whallon et al.
3,263,713 A 8/1966 Tarcza et al.
3,279,599 A * 10/1966 Drennan ..... B07C 5/124 209/531
3,591,047 A * 7/1971 Buhle ..... B65B 43/44 221/151
3,710,928 A * 1/1973 van Zijp ..... B67B 3/003 198/803.7
3,973,603 A * 8/1976 Franz ..... B67C 3/24 141/114
4,551,025 A * 11/1985 Ames ..... A23G 9/163 366/144
4,582,102 A * 4/1986 Risser ..... B67C 3/202 141/144
4,736,831 A * 4/1988 Fields ..... B65G 47/24 198/395
4,830,169 A * 5/1989 Nariki ..... B65C 9/04 118/319
4,974,716 A * 12/1990 Yuri ..... B65C 9/04 118/319
5,050,369 A * 9/1991 Fiwek ..... B67B 3/06 53/282
5,058,731 A 10/1991 Corniani et al.
5,373,933 A * 12/1994 Planke ..... B65G 21/2036 198/689.1
5,413,153 A * 5/1995 Zwilling ..... B65B 39/004 141/302
5,581,975 A * 12/1996 Trebbi ..... B65G 47/847 53/282
5,749,631 A * 5/1998 Williams ..... B41F 17/22 101/37
5,826,400 A * 10/1998 Martin ..... B65G 47/846 53/367
6,467,609 B1 * 10/2002 Williams ..... B41F 17/22 198/370.12
6,523,670 B1 * 2/2003 Simkowski ..... B65G 47/32 198/438
6,817,386 B2 * 11/2004 Tsukano ..... B67C 3/281 141/146
7,055,676 B2 * 6/2006 Hartness ..... B65G 17/323 198/468.2
7,559,232 B2 * 7/2009 Meckl ..... G01M 3/34 198/478.1
2005/0268988 A1 12/2005 Cavallari
2009/0314385 A1 * 12/2009 Goldbrunner ..... B67C 3/04 141/83
2010/0132834 A1 * 6/2010 Clusserath ..... B67C 3/004 141/115
2011/0030843 A1 * 2/2011 Krulitsch ..... B67C 3/2614 141/311 R

FOREIGN PATENT DOCUMENTS

DE 14 82 615 4/1970
DE 602 02 647 1/2006
DE 10 2006 017 706 10/2007
JP 8 151117 6/1996
JP 2001002240 A * 1/2001
JP 2003095430 A * 4/2003
JP 2004233129 A * 8/2004
JP 2010 023919 2/2010
JP 2010095385 A * 4/2010 ..... B65G 47/848
JP 2011152978 A * 8/2011

* cited by examiner

FILLING DEVICE

RELATED APPLICATIONS

Under 35 USC 371, this application is the national stage entry of PCT/EP2012/002708, filed Jun. 28, 2012, which claims the benefit of the Aug. 26, 2011 priority date of German application DE 10 2011 111 321.9, the contents of which are herein incorporated by reference.

FIELD OF INVENTION

The invention relates to a device for filling cans or similar containers with a liquid fill, for example with an uncarbonated liquid fill.

BACKGROUND

Generic devices for filling cans or similar containers with a liquid fill, for example with an uncarbonated liquid fill, are known. These devices comprise, for example, a rotor that can be driven to rotate about a vertical machine axis, the rotor having a large number of filling positions, each with a can holder and with a filling element arranged above the can holder on the rotor or on a filling element support located there. The cans to be filled are fed to the rotor or to the filling positions at a can pick-up station and are moved by the rotor to a can set-down station.

In order to accurately fix the can's position or orientation relative to the filling element, it is known to provide a fixing and centering bell on the filling element and to move he filling element and the can to be filled relative to one another in such a way that the can is centered by the fixing and centering bell and is held with its can opening bearing tightly against the filling element.

One disadvantage of this is that the centering bells result in considerable design complexity and that the touching of the top of the cans by the fixing and centering bells risks contaminating the cans and the fill accommodated inside the cans. Unfortunately, the contamination even of just one fixing and centering bell results in the contamination of whole batches of cans.

SUMMARY

An object of the invention is to provide a device for filling cans with a fill that, with a simplified design and with high operational reliability, reduces the risk of contamination of the cans to be filled and of the fill contained therein and at the same time optimally fixes the can relative to the filling element in the correct position.

An essential aspect of the device according to the invention is that between a can pick-up station and a can set-down station, without touching a filling element, and with either its opening exposed or with its opening's rim exposed, the can is fixed at least temporarily on the circumferential side with respect to the rotor and/or to the filling element support and/or that the can is fixed at least temporarily with respect to the rotor by an underpressure acting on the can bottom.

Within the context of the invention, free-jet filling is to be understood to mean a method in which the liquid fill flows in a free jet of fill towards a can that is to be filled, wherein the can does not bear with its can opening against the filling element but rather is spaced apart from the filling element and from a filling element outlet opening located there.

In one preferred embodiment, the filling device is designed for a hot free-jet filling or hot aseptic free-jet filling of the cans in which hot fill is introduced into the cans in a free jet of fill.

Within the context of the invention, the expression "essentially" or "approximately" means deviations of +/−10%, preferably +/−5%, from the exact value in each case and/or deviations in the form of changes that do not affect the function.

BRIEF DESCRIPTION OF THE FIGURES

Further developments of the invention form the subject matter of the dependent claims. The invention will be explained in more detail below with reference to the figures and on the basis of examples of embodiments. In the figures:

DETAILED DESCRIPTION

Figure 1:
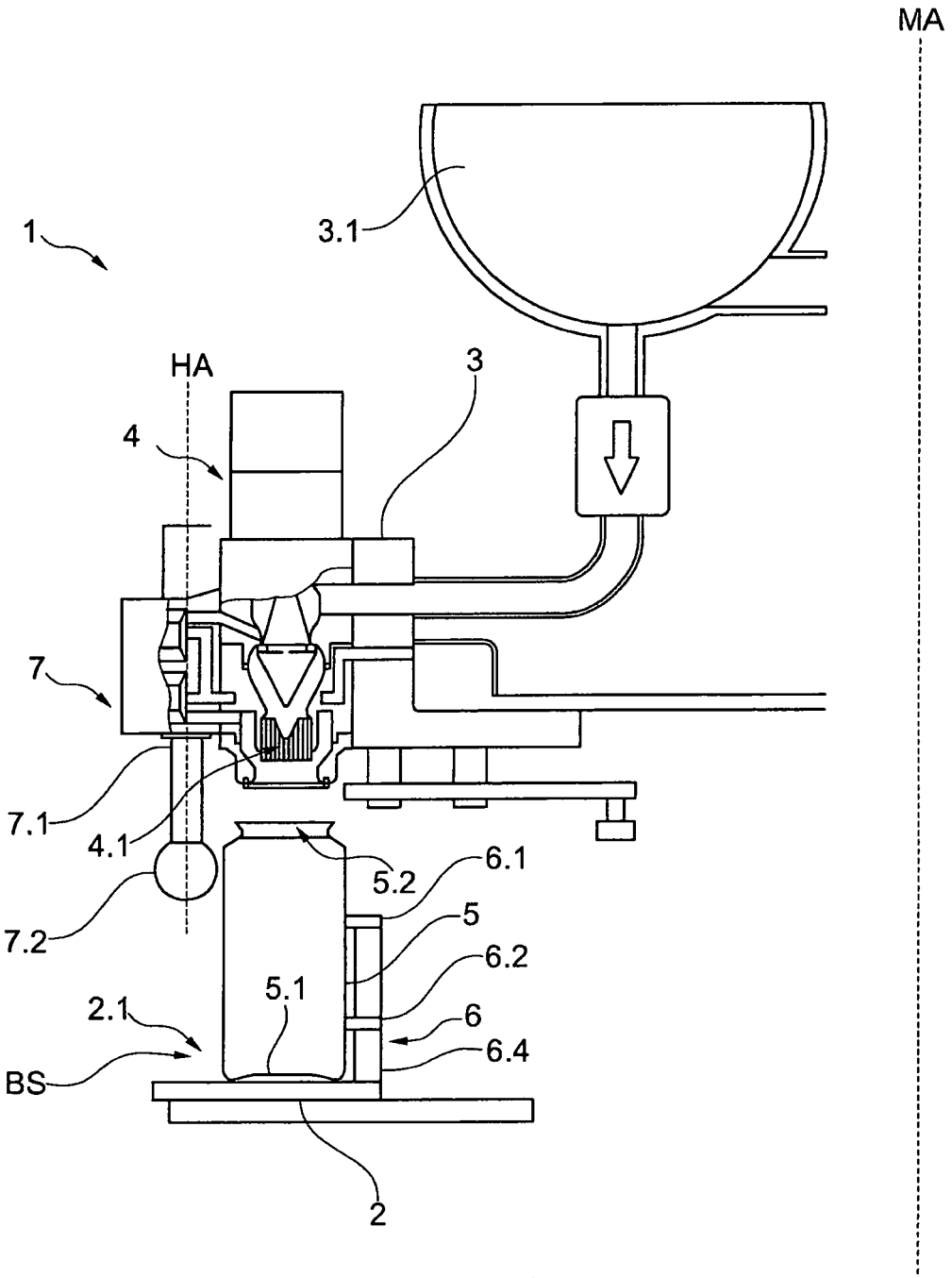
FIG. 1 shows a filling device according to the invention in a sectional plane that includes the vertical machine axis.
Figure 2:
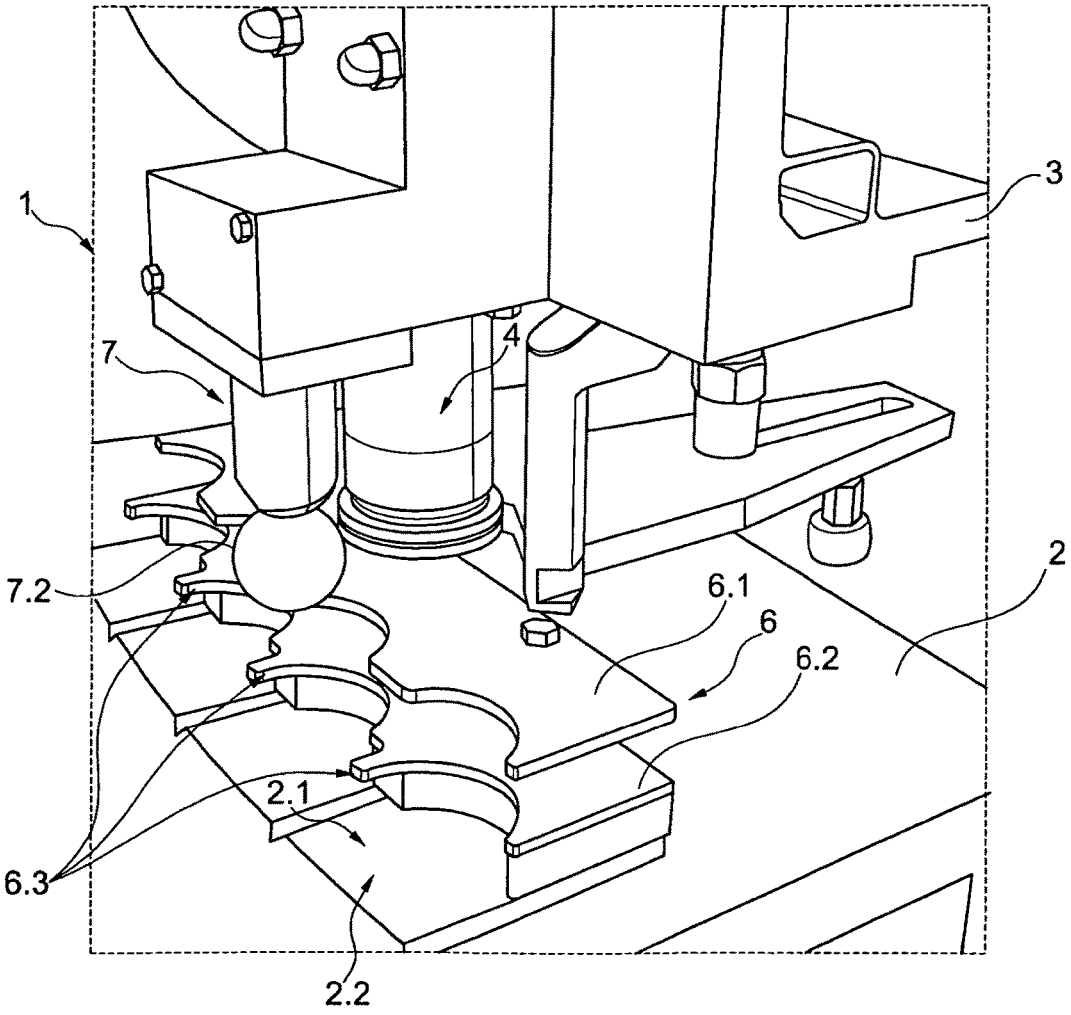
FIG. 2 shows a filling device according to the invention in a perspective partial view.
Figure 3:
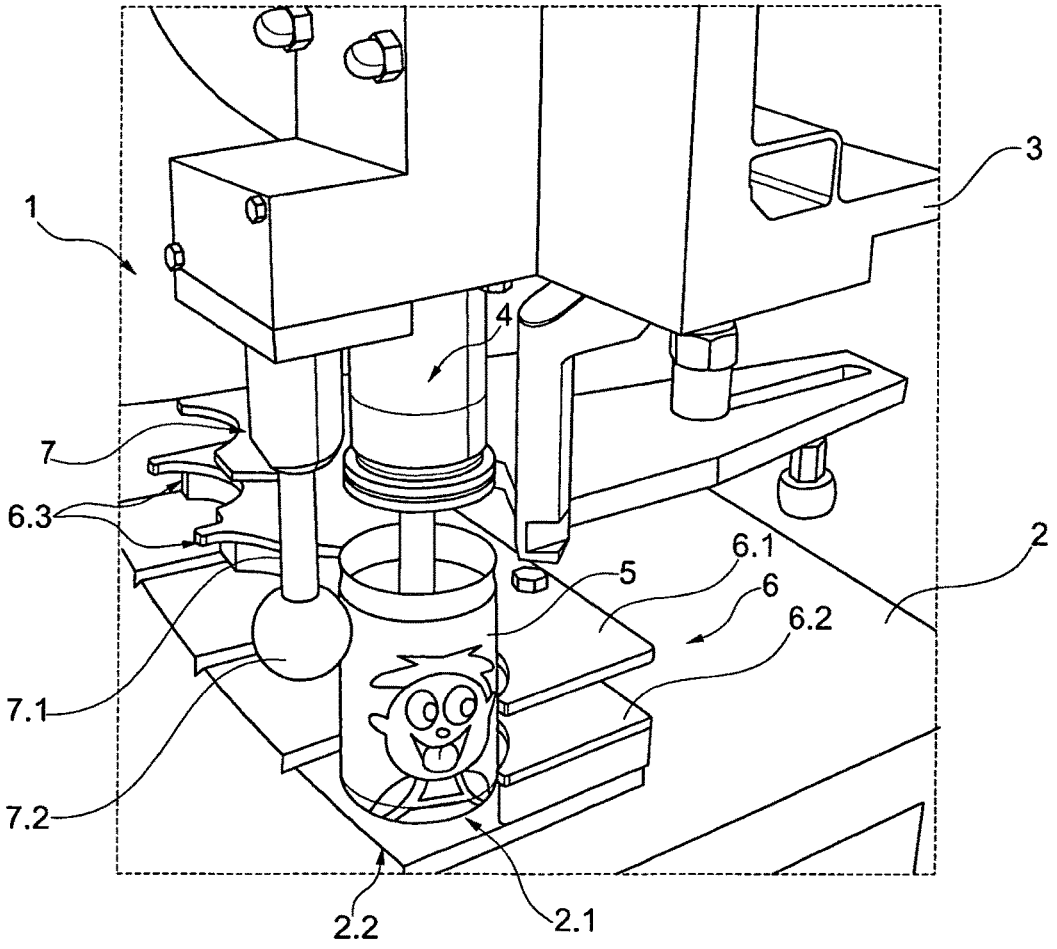
FIG. 3 shows the filling device according to the invention as shown in FIG. 2, with a can fixed in a positionally accurate manner.

In FIGS. 1 to 3, reference 1 in each case denotes a filling device of the rotary type according to the invention in a first example embodiment.

The filling device 1, which is designed for the pressureless filling or free-jet filling, preferably for the hot free-jet filling, of cans with an uncarbonated liquid, comprises a rotor 2 that can be driven to rotate about a vertical machine axis MA and which has a large number of can holders 2.1.

Provided above the rotor 2 are filling elements 4 that are assigned to the respective can holders 2.1 and that, in each case together with the respectively associated can holders 2.1, form a plurality of filling locations. The filling elements 4 are provided on a ring-shaped filling element support 3 in a manner spaced apart from one another at fixed angular spacings, wherein the filling element support 3 is attached to the rotor 2 and can be driven in rotation jointly therewith about the vertical machine axis MA.

As indicated by the arrow denoted BS in FIG. 1, the cans 5 are pushed in at a can pick-up station, for example in a radial direction relative to the machine axis MA, so that in each case one can 5 is arranged resting with its can bottom 5.1 on a can holder 2.1 and with its can axis parallel to the machine axis MA.

Provided above the can holders 2.1, in a direction parallel to the machine axis MA, is in each case the associated filling element 4, which has a fill outlet or filling element outlet 4.1 that is arranged above the can opening 5.2 and at a distance therefrom. The rotor 2 and the filling element support 3 are driven in synchrony with one another in rotation about the machine axis MA so that as the rotor 2 rotates, the can 5 is arranged with its can opening 5.2 always centered below the filling element outlet 4.1 of the filling element 4 and thus can be filled with the fill or with the liquid in the angular range of the rotational movement of the rotor 2 between the can pick-up station and the can set-down station.

The filling elements 4 are each connected via pipelines to a ring bowl 3.1 for holding the fill, the ring bowl being arranged above the filling element support 3. Provided in each of the filling elements 4 is a liquid valve that is opened and closed in a controlled manner in order to achieve the desired fill level and/or fill quantity in the can 5.

In contrast to known methods, the filling of the cans 5 takes place in a pressureless manner using a free jet, wherein no contact takes place between the filling element 4 and the can 5, in particular the can opening 5.1 and the rim of the opening. This effectively avoids contamination of the can 5 and of the liquid fill introduced into the can. In order nevertheless to achieve the necessary fixing and centering of the can 5 on the rotor 2, each can 5 is fixed at least temporarily on the circumferential side with respect to the rotor 2 and/or to the filling element support 3, specifically mechanically and/or by means of an underpressure acting on the can bottom 5.1.

In the example of embodiment shown in FIGS. 1 to 3, the fixing of the can 5 takes place mechanically by means of a clamping of the can 5 between a holder 6, which is arranged in a stationary manner on the rotor 2, and a movable clamping element 7.

In the illustrated example of embodiment shown in FIGS. 1 to 3, the holder 6 is formed by a holder mount 6.4 that protrudes towards the filling element support 3 from the part of the rotor 2 forming the can holders 2.1, and a first and a second holder element 6.1, 6.2 arranged on the holder mount 6.4. Here, the holder elements 6.1, 6.2 are preferably arranged to be spaced apart from one another in the direction of the machine axis MA so that spatially distributed bearing surfaces are formed by the holder 6 along the vertical axis of the can 5.

With particular preference, the first and second holder elements 6.1, 6.2 have arc-shaped recesses 6.3, the arc radius of which is adapted to the radius of the can 5 to be held to form an at least partially circumferential bearing surface for the can 2. In the illustrated embodiment, the arc-shaped recesses 6.3 are open radially towards the outside in relation to the machine axis MA so that the cans 5 at the can pick-up station, with respect to the machine axis MA, can be placed radially inwards onto the rotor 2 and can be pushed radially inwards onto the can holding locations 2.1, so that, in the end position, the can bears with part of its circumference against the first and second holder element 6.1, 6.2.

Cutouts 2.2 that are adapted to the respective can bottom 5.1 can preferably be provided in the rotor 2. These cutouts bring about additional lateral guidance and centering of the can 5 when the can is pushed in at the can pick-up station.

As shown in the illustrated embodiment, holder elements 6.1, 6.2, which are in the shape of a ring or a segment of a ring, may be provided as the holders 6, with the holder elements have a large number of arc-shaped recesses 6.3 arranged on the outer circumference. As an alternative, individual holders 6 may also be provided, wherein in each case one such individual holder is assigned to a can holder 2.1 or a filling element 4.

In order to prevent the cans 5 from moving radially outwards from the arc-shaped holders 6, particularly when the rotor 2 and the filling element support 3 are rotating at high angular speeds, the illustrated embodiment has each filling element 4 being assigned a clamping element 7 that is arranged radially outwards, relative to the machine axis MA, on the housing of the filling element 4. This clamping element 7 is designed as a lifting cylinder and has a lifting rod 7.1 that is guided in a cylinder bushing and that has, at the free end, a lifting rod end 7.2 that protrudes radially from the lifting rod 7.1 at least on the side facing towards the can 5, and with this lifting rod end 7.2 comes to bear, preferably on the side diametrically opposite the holder 6, at least partially against the circumference of the can 5, specifically outside the can opening 5.2. The lifting rod 7.1 in this case can be positioned at least in a retracted position (FIG. 2) and in an extended position (FIG. 1, FIG. 3). In the retracted state of the lifting rod 7.1, it is possible for the can to be introduced into or removed from the can holding location 2.1. In the extended state of the lifting rod 7.1, the can is locked in a clamped or substantially clamped manner but at least in a contact-free manner between the lifting rod end 7.2 and the holder 6. The axis of the lifting rod is offset radially relative to the can axis, specifically, radially outwards relative to the machine axis MA.

During operation of the filling device 1 according to the invention, a can 5 is fed to each individual can holder 2.1 at the can pick-up station by being pushed radially inwards relative to the machine axis MA. Here, the lifting rod 7.1 of the clamping element 7 is pushed so far into the lifting cylinder element that the pushing-in of the can 5 is not hindered by the lifting rod end 7.2 at the free end. By pushing out the lifting rod 7.1, the can 5 is then held between the holder 6 and the lifting rod end 7.2 as described above. The controlled filling of the can 5 by means of the filling element 4 located above it takes place in this position. During the filling operation, the can 5 is moved from the can pick-up station to the can set-down station by the rotor 2 which is driven in rotation. Upon reaching the can set-down station, the lifting rod 7.1 is pushed in to release the can for subsequent removal from the can holding location 2.1.

As an alternative, the fixing of the can 5 may take place mechanically by means of two clamping elements that can move with respect to one another in the manner of tongs and that are provided on the rotor 2 or on the filling element support 3.

Figure 4:
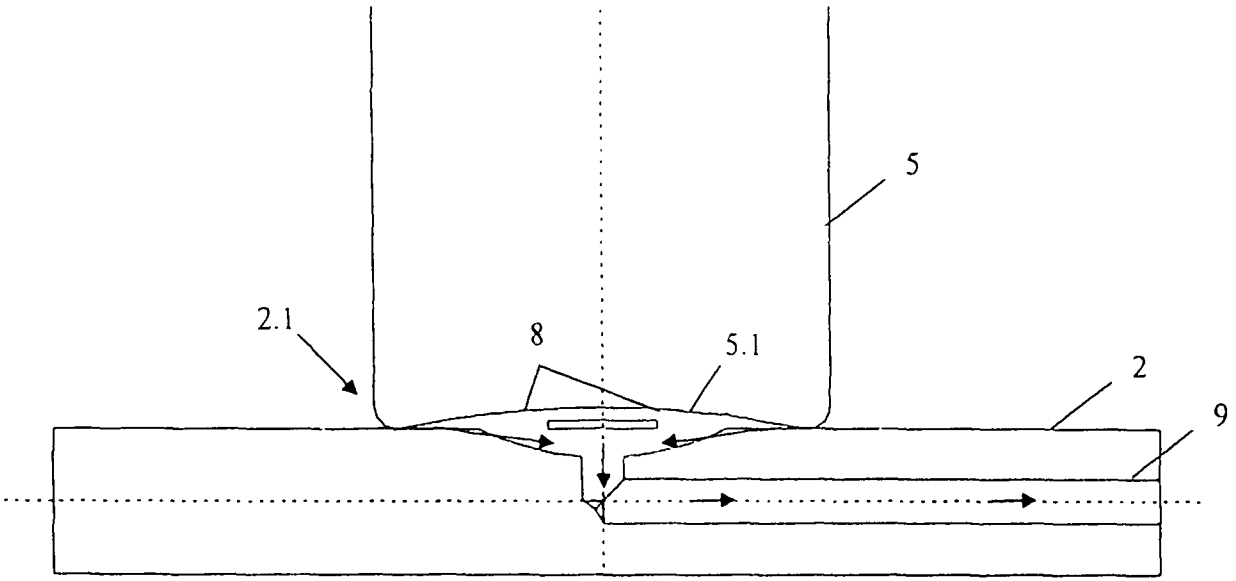
FIG. 4 shows a schematic sectional view of a rotor of a filling device according to the invention, with a can fixed to the rotor or to a filling position by underpressure.

FIG. 4 shows another possibility for fixing the can 5 with respect to the rotor 2, which can be provided as an alternative or in addition to the aforementioned clamping attachment of the can 5 to the rotor 2. To this end, there is provided in the region of the can holder 2.1 at least one opening 8 that is connected to a channel 9 provided in the rotor 2. This channel 9 can be connected to at least one underpressure-generating unit, so that an underpressure is generated on the can bottom 5.1 via the opening 8 and the can 5 is attached to the rotor 2 by suction.

Figure 5:
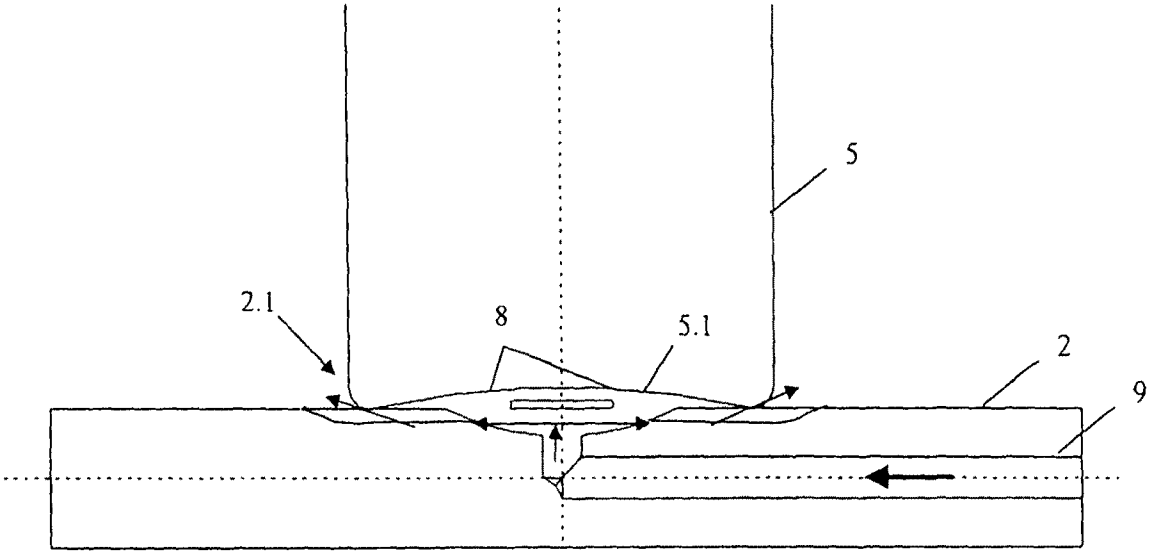
FIG. 5 shows a schematic sectional view of an alternative embodiment in which the rotor of the filling device according to the invention with a can fixed to the rotor using compressed air.

As an alternative, as shown in FIG. 5, compressed air can be fed towards the openings 8 via the channel 9, wherein, as indicated by the arrows, an underpressure is generated on the can bottom 5.1 in a manner comparable to a fluid jet pump due to the compressed air flow escaping laterally below the can bottom 5.1.

Figure 6:
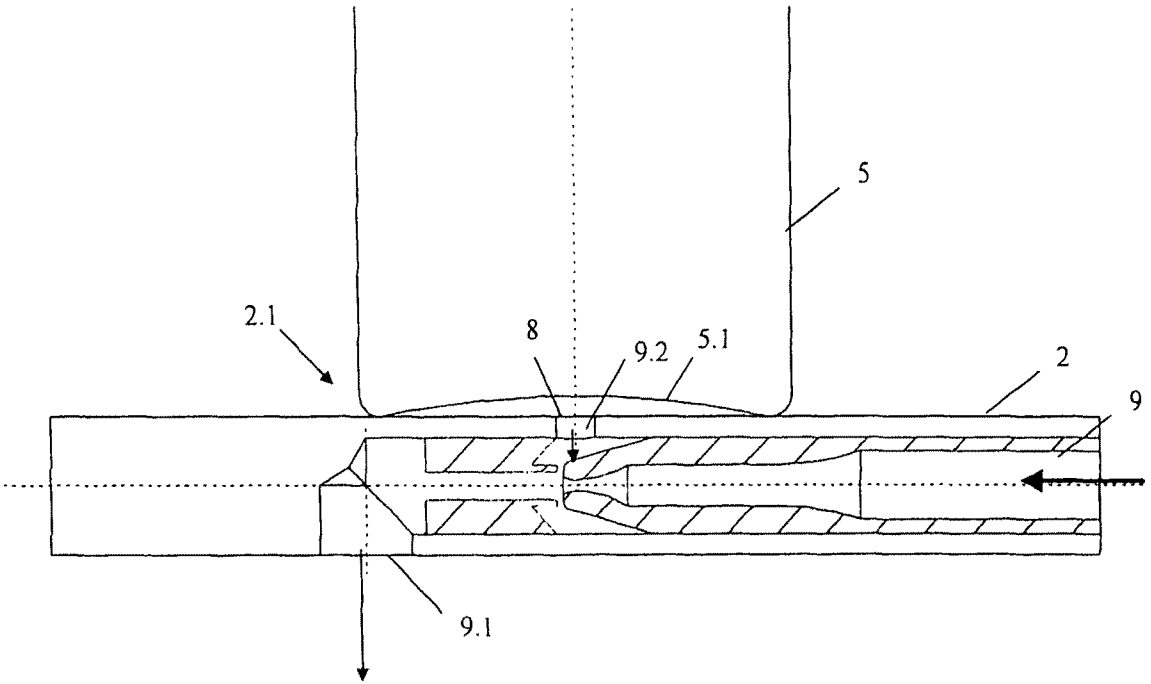
FIG. 6 shows a schematic sectional view of the rotor of the filling device according to the invention, with a can fixed to the rotor using compressed air in a further variant embodiment.

Furthermore, as shown in FIG. 6, there may be provided, within the rotor 2, a channel 9 that has, for example, a channel outlet opening 9.1 that is located opposite the can holder 2.1 and via which compressed air that has been fed into the channel 9 can escape outwards. Incorporated in the rotor 2 is a further channel section 9.2 that runs transversely, in particular at right angles, to the channel 9 and that opens with a channel section end into the channel 9. The other channel section end of the channel section 9.2 forms the opening 8, which is provided in the region of the can holding location 2.1. Passing a flow of compressed air through the channel 9 generates a suction effect similar to that of a fluid jet pump. This suction holds the can bottom 5.1 securely against the rotor 2.

The invention has been described above on the basis of examples of embodiments. It will be understood that numerous changes and modifications are possible without thereby departing from the inventive concept on which the invention is based.

LIST OF REFERENCES

1 filling device
2 rotor
2.1 can holder or can holding position
2.2 cutout
3 filling element support
3.1 ring bowl
4 filling element
4.1 filling element outlet
5 can
5.1 can bottom
5.2 can opening
6 holder
6.1 first holder element
6.2 second holder element
6.3 recess
6.4 holder mount
7 clamping element
7.1 lifting rod
7.2 lifting rod end
8 opening
9 channel
9.1 channel outlet opening
9.2 channel section
MA machine axis
HA lifting axis

The invention claimed is:

1. An apparatus comprising a machine for filling cans with liquid fill, said machine for filling cans comprising a rotor, can holders, filling elements, a filling-element support, a can-pickup station, a can set-down station, and a clamping element, wherein said liquid fill is uncarbonated, wherein said rotor turns about a vertical machine-axis, wherein said rotor causes both said cans and said filling-element support to rotate about said vertical machine-axis, wherein said can holders are constituents of said rotor, wherein each of said filling elements is disposed above a corresponding can holder, wherein each can holder is associated with a filling element, wherein a can holder and an associated filling element define a filling position, wherein, during a filling operation, said rotor is configured to move a can from said can pick-up station to said can set-down station, wherein said clamping element is configured such that, during said filling operation, said clamping element extends below an exposed can opening of said can and bears radially against a surface of said can, wherein said clamping element comprises a lifting rod having a vertical lifting-rod axis that is offset relative to an axis of said can, said vertical lifting-rod axis being offset in a radial direction relative to said can, wherein said clamping element moves in a vertical direction along said lifting-rod axis between a position in which said clamping element has been retracted away from said rotor and a position in which said clamping element has been extended toward said rotor, wherein said clamping element is connected at least indirectly to said filling-element support, wherein, as a result of being connected to said filling-element support, said clamping element rotates about said vertical machine axis with said can and with said filling-element support, and wherein said filling operation is selected from the group consisting of free-jet filling, and hot free-jet filling.

2. The apparatus of claim 1, wherein said clamping element moves along an axis that is offset from an axis of said can by an amount that is at least equal to a radius of said can.

3. The apparatus of claim 1, further comprising a holder that comprises holder elements, wherein said holder elements are spaced apart from one another along the direction of said machine axis, wherein said holder cooperates with said clamping element to fix said can.

4. The apparatus of claim 1, further comprising a first holder-element and, in addition to said first holder-element, a second holder element, wherein said first holder element is a constituent of a holder, wherein said second holder element, like said first holder element, is also a constituent of said holder, wherein said holder cooperates with said clamping element to fix said can, and wherein said first and second holder elements define an arc-shaped recess adapted to a diameter of said can.

5. The apparatus of claim 1, further comprising a holder that comprises a holder element, wherein said holder element is a segment of a ring, and wherein said holder has arc-shaped recesses arranged on an outer circumference, wherein said holder cooperates with said clamping element to fix said can.

6. The apparatus of claim 1, wherein said clamping element is arranged above said rotor at a location that is radially further from said machine axis than said can.

7. The apparatus of claim 1, wherein said clamping element is arranged on said filling-element support.

8. The apparatus of claim 1, further comprising an opening in said rotor, wherein said opening is in a region of said can holders, and wherein said opening is connected to a channel through which a fluid flows, whereby said fluid flow generates an underpressure at said opening for fixing said can to said rotor.

9. The apparatus of claim 1, wherein said lifting rod comprises a lifting-rod end that protrudes radially from said lifting rod at least on a side facing a can.

10. The apparatus of claim 9, wherein said lifting rod is disposed such that said lifting-rod end comes to bear along different portions of said can as said lifting rod moves along said lifting-element axis straight toward said rotor.

11. The apparatus of claim 9, wherein said lifting rod is disposed to transition between an upper state, in which said lifting-rod end does not engage a can, and a lower state, in which said lifting-rod end comes to bear against a wall of said can, wherein, during said transition, said lifting rod moves along said lifting-rod axis.

12. The apparatus of claim 9, wherein said lifting-rod end is spherical.

13. The apparatus of claim 1, wherein said clamping element translates vertically between a retracted position in which said clamping element is not above said exposed can opening and an extended position in which said clamping element is beside said can.

14. The apparatus of claim 1, wherein, during said filling operation, a free jet of said liquid fill flows toward a can at said can holder, said can being spaced from said filling element such that a can opening of said can does not bear against said filling element.

15. The apparatus of claim 1, further comprising a holder mount that protrudes in a direction that is toward said filling-element support, said holder mount protruding from a portion of said rotor that forms said can holders, said apparatus further comprising a first bearing surface and a second bearing surface, said first and second bearing surfaces extending along a direction that is parallel to said vertical axis of said can.

16. The apparatus of claim 1, wherein said lifting rod comprises a lifting-rod end that protrudes radially from said lifting rod at least on a side facing a can, wherein said lifting rod is in a retracted position when said clamping element has moved in said vertical direction along said lifting-rod axis between said position in which said clamping element has been retracted away from said rotor and wherein said lifting rod is in an extended position when said clamping element has been extended toward said rotor, wherein, when said lifting rod is in said retracted position, said lifting-rod end does not engage a can, and wherein, when said lifting rod is in said extended position, said lifting-rod end comes to bear on said can.

17. The apparatus of claim 1, wherein said can is filled during rotational movement of said rotor between said can pick-up station and said can set-down station, wherein, upon reaching said can set-down station, said lifting rod moves along said vertical lifting-rod axis to permit release of said can.

18. The apparatus of claim 1, wherein, at a filling position thereof, said rotor comprises an opening and a channel, wherein said can covers said opening while said can is being filled and wherein said channel connects to said opening.

19. The apparatus of claim 1, wherein said rotor comprises, for each filling position, a channel and an opening connected to said channel, wherein, during filling thereof, said can is positioned to allow gas in said channel to escape out of said opening by flowing in a radial direction away from said axis of said can.

20. The apparatus of claim 1, wherein, for each filling position, said rotor comprises first and second openings facing in opposite directions and first and second channels, said first channel extending radially and said second channel extending transverse from said first channel to said second opening, wherein during filling thereof, said can is positioned to cover said first opening and to allow gas traveling in said first channel to pass into said second channel and escape out of said second opening.

* * * * *